US008870990B2

(12) United States Patent
Marks et al.

(10) Patent No.: US 8,870,990 B2
(45) Date of Patent: Oct. 28, 2014

(54) FILTRATION SYSTEM FOR A PARTICULATE STORAGE FRACKING TRAILER

(71) Applicant: Halliburton Energy Services, Inc., Houston, TX (US)

(72) Inventors: Alexander Lynn Marks, Duncan, OK (US); Kary Layne Covington, Duncan, OK (US); Johnny Ray Sanders, Jr., Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 131 days.

(21) Appl. No.: 13/651,742

(22) Filed: Oct. 15, 2012

(65) Prior Publication Data

US 2014/0102301 A1 Apr. 17, 2014

(51) Int. Cl.
*B01D 46/00* (2006.01)
*B01D 50/00* (2006.01)

(52) U.S. Cl.
USPC ..... 55/385.1; 55/283; 55/302; 55/304; 55/319; 55/315.1; 55/385.3; 55/356; 55/323; 55/418.1; 55/419; 55/467.1; 55/DIG. 10; 95/268; 95/280; 95/284; 95/279; 96/135; 96/136; 96/138; 96/140; 96/142; 126/343.5; 422/169; 422/182; 454/63; 454/64; 454/65; 454/92; 454/117

(58) Field of Classification Search
USPC ..... 55/283, 302, 304, 319, 315.1, 385.1, 55/385.3, 356, 323, 418.1, 419, 467.1, 55/DIG. 10; 95/268, 280, 284, 279; 96/135, 136, 138, 140, 142; 126/343.5; 422/169, 182; 454/63, 64, 65, 92, 117
See application file for complete search history.

(56) References Cited

U.S. PATENT DOCUMENTS

| | | | | |
|---|---|---|---|---|
| 4,723,969 | A * | 2/1988 | DeMarco | 95/284 |
| 4,820,315 | A * | 4/1989 | DeMarco | 95/268 |
| 5,053,063 | A * | 10/1991 | Sisk | 55/304 |
| 5,199,354 | A * | 4/1993 | Wood | 110/241 |
| 5,762,664 | A * | 6/1998 | Vross et al. | 55/319 |
| 5,873,919 | A * | 2/1999 | Vross et al. | 55/315.1 |
| 6,736,885 | B2 * | 5/2004 | Kaiser | 96/224 |
| 7,694,703 | B2 | 4/2010 | Grady | |
| 8,118,900 | B2 | 2/2012 | Raether et al. | |
| 8,226,786 | B2 | 7/2012 | Schrage et al. | |
| 2009/0255227 | A1 | 10/2009 | Schrage et al. | |
| 2010/0293906 | A1 | 11/2010 | Flagstad et al. | |
| 2011/0083559 | A1 | 4/2011 | Raether | |

OTHER PUBLICATIONS

National Oilwell Varco, "Sand Storage Tanks and Belt Conveyors" http://www.nov.com/Well_Service_and_Completion/Frac_Sand_Handling_Equipment/Sand_Storage_Tanks.aspx, Sep. 5, 2012 (1 page).

(Continued)

*Primary Examiner* — Robert Clemente
*Assistant Examiner* — Minh-Chau Pham
(74) *Attorney, Agent, or Firm* — John W. Wustenberg; Fish & Richardson

(57) ABSTRACT

A fracking trailer includes a particulate storage enclosure to receive a mixture of particulate and air in an interior of the particulate storage enclosure having a front end and a rear end. The fracking trailer also includes a filtration system connected to the particulate storage enclosure at the front end to filter particulate from the air in the mixture and exhaust filtered air.

23 Claims, 5 Drawing Sheets

(56) References Cited

OTHER PUBLICATIONS

Photo of an Appco model DCS 580 Quad dust collection system, photo taken Jun. 18, 2012.

Aircleaning Technologies, "Halliburton CPV2 Twin" 2012 (1 page).

Smoot, "6x6 Hydraulic Drive" Aug. 8, 2012 (1 page).

Halliburton, "Model FSR-2500 Mountain Mover Proppant Storage/Conveyor" 2012 (1 page).

* cited by examiner

FILTRATION SYSTEM FOR A PARTICULATE STORAGE FRACKING TRAILER

TECHNICAL FIELD

This disclosure relates to filtering particulates from a mixture of air and particulates.

BACKGROUND

Hydraulic fracturing includes the propagation of fractures in a rock layer due to the action of a pressurized fluid. Induced hydraulic fracturing ("fracking") can be used to release hydrocarbons, for example, petroleum, natural gas, and the like, for extraction. The pressurized fluid used in fracking can include particulate, such as sand, respirable crystalline silica (RCS), and similar small materials, that can be mixed with industrial fluids, such as water, and flowed into the rock layer (or a wellbore) at a production site under pressure to stimulate fracture. The particulate can be carried to the production site in vehicles such as semi-trailers ("fracking trailers"). The fracking trailers can be filled with the particulate by blowing a mixture of particulate and air into the trailers, for example, through hoses. Some of the particulate may be blown out of the trailer with the air that carried the particulate into the trailer. Such a mixture of particulate and air may be blown into areas surrounding the fracking trailers, thereby increasing a risk of exposure to the small-sized particulate. Decreasing such exposure can decrease chances of respiratory diseases such as silicosis and lung cancer.

DESCRIPTION OF DRAWINGS

Like reference symbols in the various drawings indicate like elements.

DETAILED DESCRIPTION

Figure 1A:
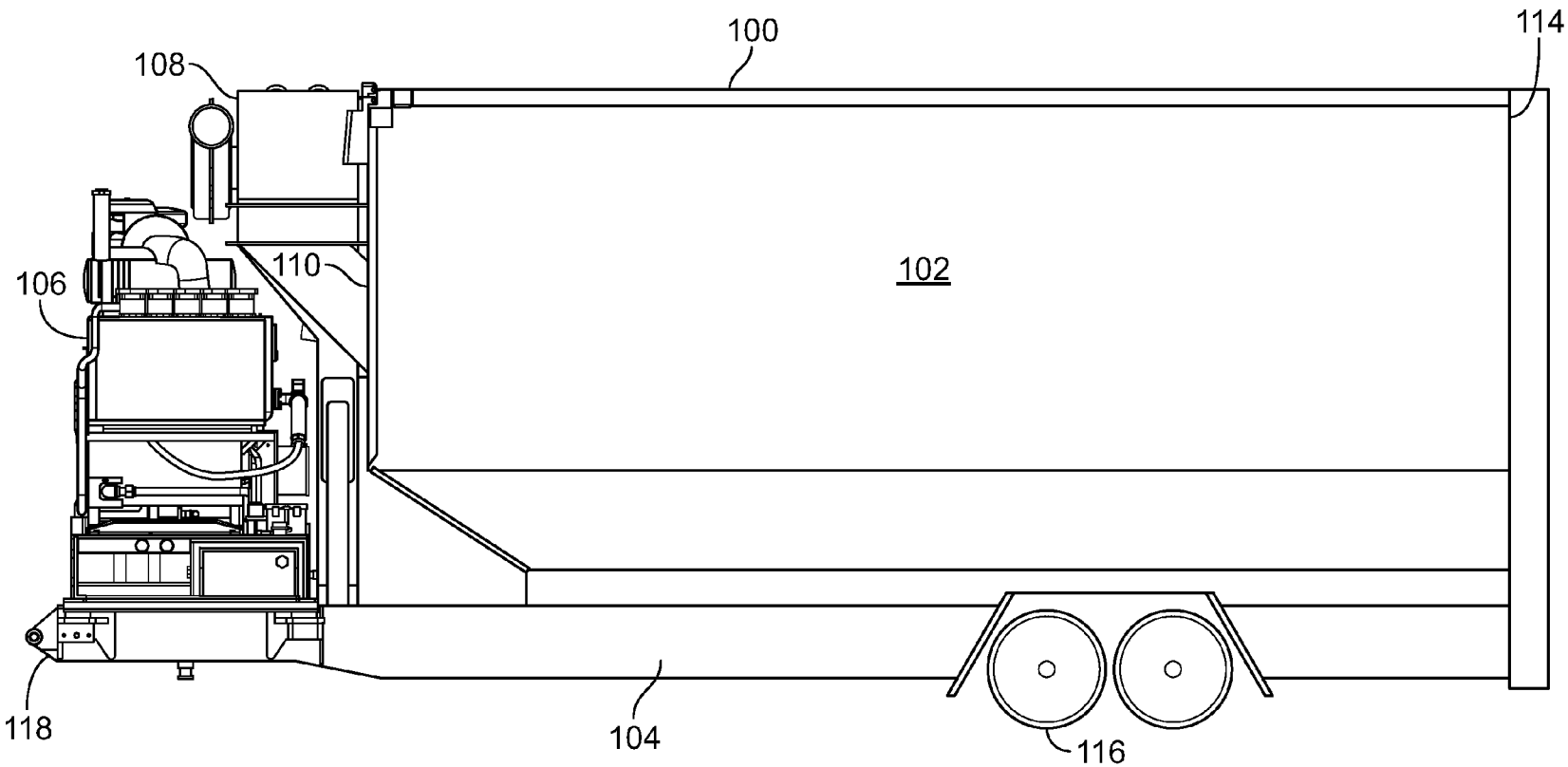
FIGS. 1A-1D are multiple views of an example of a filtration system carried by the particulate storage fracking trailer.

This disclosure describes a filtration system for a particulate storage fracking trailer to filter particulate from a mixture of particulate and air that can blow out of a fracking trailer during filling operations. In general, a particulate storage fracking trailer includes a particulate storage enclosure which can be filled with particulate by mixing the particulate with air and flowing the mixture into the enclosure. As the enclosure fills with particulate, the air can exit the enclosure, carrying with it some of the particulate. The filtration system, which is connected to the particulate storage enclosure, can filter the particulate from a mixture of particulate and air exiting the enclosure. An exhaust fan included in the filtration system causes the mixture to be flowed through filtration media that captures the particulate in the mixture thereby separating the particulate from the air. The filtration system includes a vent through which the filtered air flows to the exterior of the particulate storage enclosure, and a collection system to collect the filtered particulate. As described below, the filtration system can be arranged at a front end of the fracking trailer between the particulate storage enclosure and an engine that provides power to the filtration system.

Implementing the filtration system described here can provide one or more of the following potential advantages. Relative to filtration systems that use many filters to filter the mixture of particulate and air, the filtration system described here can be simpler in construction, lighter in weight, smaller in size, and cheaper. Consequently, such a filtration system can be sufficiently compact to fit in a front end of the trailer, for example, between the engine and the particulate storage enclosure. Positioning the filtration system in the front end can decrease a load on a rear axle of the trailer and can decrease or prevent wear due to a cantilever effect caused if the filtration system were positioned at a rear end of the truck. A fracking trailer carrying the lighter weight filtration system may, in certain instances, be below the weight permitted load for road travel under regulations established by the governing bodies, such as The United States Department of Transportation. This can result in a decrease in costs associated with transporting the fracking trailer.

Moreover, as described below, the filtration system can use nano-filtration media that are more efficient relative to tubular filter cartridges. The nano-filtration media can provide more surface area to capture particulates relative to tubular filter cartridges, and additionally can contribute to a decrease in the size and the weight of the filtration system. The filtration system can protect not only the personnel working with or around the fracking trailer but also the environment by decreasing or removing potentially hazardous particulates from the air being exhausted from the particulate storage enclosure. The filtration system can also enable the fracking operations to be in compliance with government regulations issued, for example, by Occupational Safety and Health Administration (OSHA).

Figure 1B:
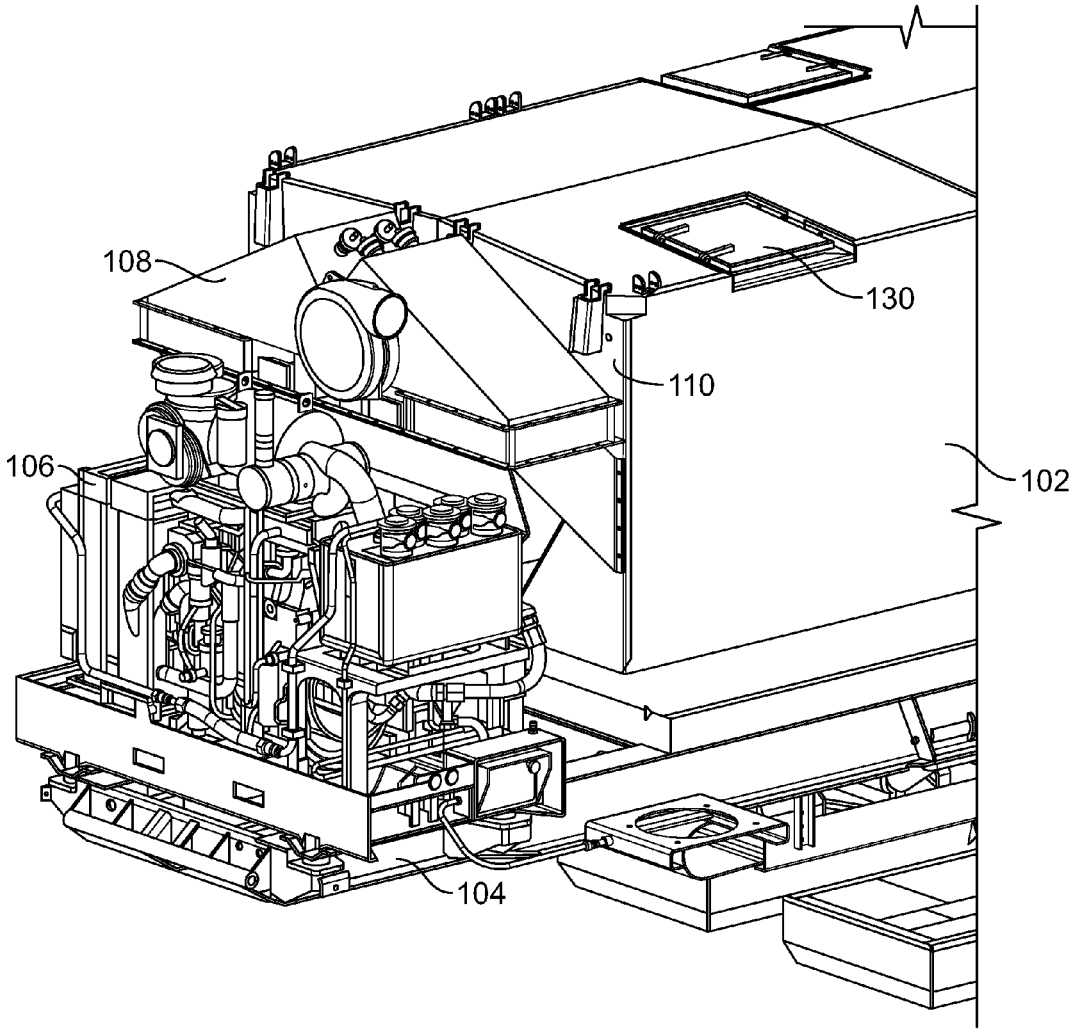
Figure 1C:
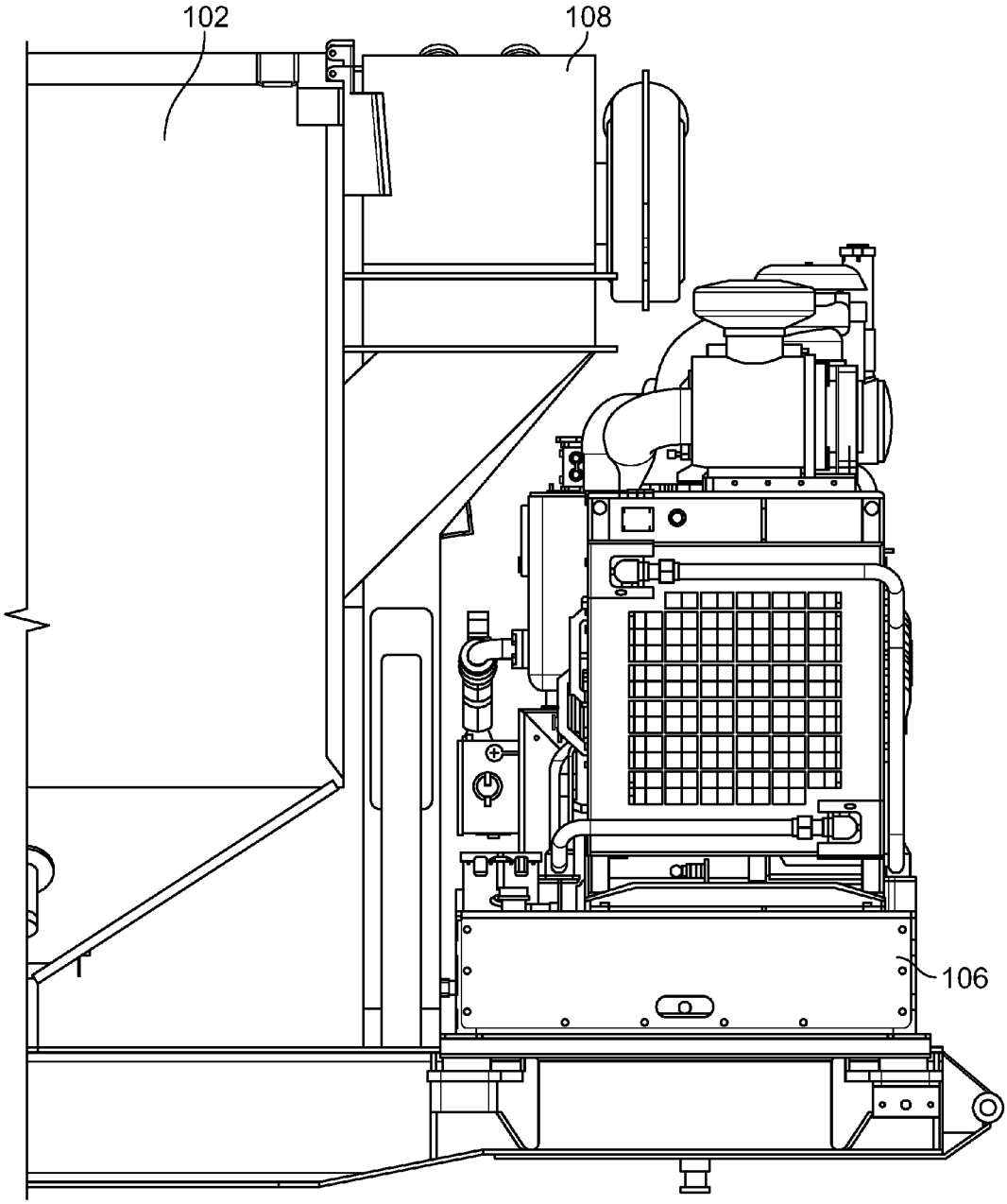

FIG. 1A shows an example of a particulate storage fracking trailer system 100 that includes a trailer frame 104 with wheels 116. The trailer frame 104 carries a particulate storage enclosure 102, which has a front end 110 and a rear end 114. The trailer frame 104 also carries an engine 106, which is arranged at the front end 110 of the particulate storage enclosure 102 such that the front end 110 is proximal to the engine 106 while the rear end 114 is distal to the engine 106. The engine 106 is an engine of a hydraulic power system. The engine 106 can drive a hydraulic pump that provides hydraulic pressure and flow to power various systems. The engine 106 may also drive a generator to provide electrical power to various systems. In addition, the trailer frame 104 carries a filtration system 108, which is connected to the particulate storage enclosure 102. For example, the particulate storage enclosure 102, the engine 106, and the filtration system 108 can be mounted to the trailer frame 104 to be carried and transported by a tractor that can be connected to a tongue end 118 of the trailer system 100. In some implementations, the filtration system 108 can be proximate to the tongue end 118 of the trailer system 100, and be arranged between the particulate storage enclosure 102 and the engine 106 (FIG. 1B). In addition, as shown in FIG. 1C, the filtration system 108 can be arranged such that a height of the filtration system 108 is greater than that of the engine 106 and is less than or equal to a trailer top height.

Figure 1D:
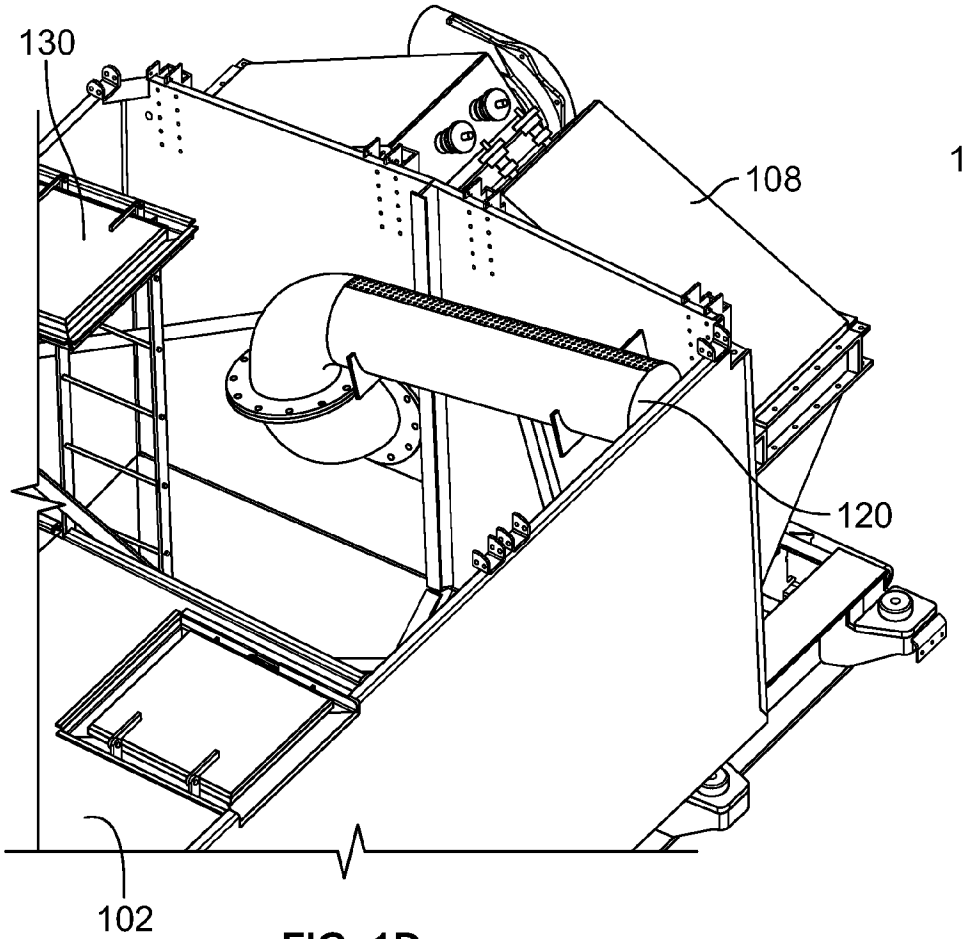

As shown in FIG. 1D, the particulate storage enclosure 102 can include a hatch 130 through which the air carrying the particulate can be flowed, for example, through a 4-inch blower (not shown) connected to the hatch 130. The enclosure 102 can be partitioned into multiple bins, each of which can have holes cut in the top middle portion of the bin wall. The mixture of particulate and air can be blown into each partition through a respective hatch that can be sealed by a respective lid. A hatch lid can include a rubber seal surrounding a flange and a plate (for example, a 45 lb plate) with a hole drilled in the middle that attaches to the lid.

Even if the hatch 130 is sealed by a lid, the mixture of particulate and air may flow out of the enclosure 102, for example, due to a pressure of the air flowed into the enclosure 102. In such situations, the filtration system 108 can receive the mixture from an interior of the enclosure 102, filter particulate from the air, and exhaust filtered air. The filtration system 108 can receive power from the engine 106 to perform these operations. In some implementations, the filtration system 108 can include an inlet pipe 120 positioned in the interior of the enclosure 102 (FIG. 1D). The filtration system 108 can draw the mixture of particulate and air from the interior of the enclosure 102 through the inlet 120, and filter the particulate in the mixture from the air in the mixture, as described below with reference to FIG. 2A.

Figure 2A:
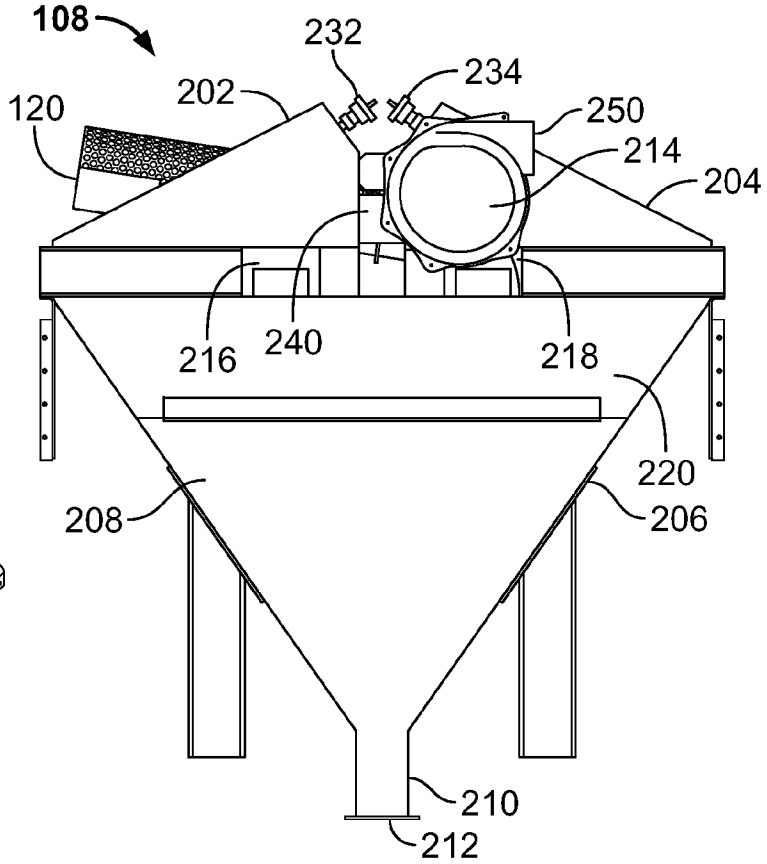
FIG. 2A is an example of a filtration system.

FIG. 2A is an example of a filtration system 108 to which the engine 106 provides power to filter the particulate from the air in the mixture. The filtration system 108 can include an exhaust fan 214 (for example, a Cincinnati Fan PB-15A 14×3¼ radial wheel configured to deliver 2000 CFM at 4.0" of water column at 3000 RPM provided by Cincinnati Fan, Mason, Ohio) that can cause the mixture of the particulate and air to flow through the filtration system 108, for example, by creating a suction. In some implementations, the inlet 120 can be a pipe, for example, of 12" diameter, which has been sectioned out and welded to an expanded metal that covers a portion of a surface area of the pipe. For example, the portion of the pipe that has the covered surface area can face the blower that blows the mixture of particulate and sand into the particulate storage enclosure 102. This arrangement can prevent the mixture from flowing directly into the inlet 120 due to the suction created by the exhaust fan 214.

The filtration system 108 can include a particulate filter to separate the particulates from the mixture and a collection system 206 to collect the separated particulates. The particulate filter (for example, Donaldson Torit® PowerCore® CPV model CPV2 provided by Donaldson Torit, Inc. of Minneapolis, Minn.) can be arranged outside the enclosure 102 and connected to the inlet to receive the mixture of particulate and air from the interior of the particulate storage enclosure. In some implementations, the filtration system 102 can include more than one particulate filter, for example, a first particulate filter 202 and a second particulate filter 204 connected to each other by a connection pipe 240. The mixture received by the inlet 120 can be flowed through the particulate filter resulting in particulate being separated from the air. In implementations including the first particulate filter 202 and the second particulate filter 204, the exhaust fan 214 can be connected to one of the two particulate filters to create suction in the filtration system 108. The exhaust fan 214 can be driven by a hydraulic motor, for example, a Parker M2B16912S20NB 5 HP hydraulic motor rated at 3450 RPM (provided by Parker Hannifin Corp., Cleveland, Ohio). The exhaust fan 214 can include a vent 250 through which the air, from which the particulate has been filtered, can be exhausted.

The particulate filter can include nano-fiber filtration media (for example, Donaldson Torit® PowerCore® CP Filter Pack provided by Donaldson Torit, Inc. of Minneapolis, Minn.) to filter the particulate from the air. In some implementations, the nano-fiber filtration media can be configured as a flat filter cartridge housed in triangular housings. Each of the particulate filters 202 and 204 can include more than one nano-fiber filtration media cartridge. For example, each particulate filter can include two such cartridges. The housings can have lids with handles that can be opened to place and retrieve the nano-fiber filtration media. Each particulate filter can have more than one nano-fiber filtration cartridge. The nano-fiber filtration media can include micro-webbings that collectively have larger surface area relative to tubular cartridge filters that are of the same size as the particulate filter but use paper or cloth filters to filter particulate. Consequently, the nano-fiber filtration media offers better filtration capacity and efficiency relative to the tubular filters with paper or cloth filters. Some of the particulates that the nano-fiber filtration media filters can be lodged in the micro-webbings of the nano-fiber filtration media. To dislodge such particles, the filtration system 108 can include air flow systems to pulse air through the nano-fiber filtration media.

The air flow systems can continuously provide pulsed air to the particulate filter to clean the nano-fiber filtration media. A compressed air manifold (not shown), for example, a 5"×5"×18' air tank, can be connected to the air flow systems to supply the compressed air that can be pulsed as air jets. An air compressor (not shown) can be carried by the trailer frame 104 and be connected to the air tank to keep the air tank filled with compressed air, for example, at a pressure of 90-100 PSIG. The air compressor can be mounted anywhere on the trailer frame 104 and need not be mounted next to the particulate filters. The air flow systems can be connected to diaphragm valves (for example, using 1" air hoses with swivel male connectors) and solenoids to control the pulsing of the air jets into the nano-fiber filtration media through connectors (for example, connector 232 for particulate filter 202 and connector 234 for particulate filter 204). For example, using a 24 volt timer (for example, with weatherproof enclosure) and solenoids (for example, NEMA solenoid enclosure with four 24 volt pilot solenoid valves provided by Omega Engineering, Inc., Stamford, Conn.), control signals can be sent from a signal box (for example, including a pulse timer board) to the air flow systems to pulse air at a rate of 15 to 30 seconds. The signal box for each particulate filter can be placed adjacent the particulate filter, for example, in slots 216, 218. Together, the first particulate filter 202 and the second particulate filter 204 can be rated for 2000 CFM.

A pressure gauge can be connected to the particulate filter. A decision to change the nano-fiber filtration media in the particulate filter can be made based on the pressure reading. For example, if the pressure according to the pressure gauge does not decrease below six inches of water column after the nano-fiber filtration media have been pulsed with jets from the air flow systems, the filtration media may need to be changed.

The collection system 206 can receive and collect the particulate filtered from the mixture, for example, for disposal or for reuse. In some implementations, the collection system 206 can be arranged below the first particulate filter 202 and the second particulate filter 204, and can be connected to the filters by a plenum 220 such that particulate filtered by the nano-filtration media fall into the collection system 206. The plenum 220 can be connected between the particulate filters and the hopper 208 at an angle to accommodate the engine 106 arranged on the trailer frame 104 next to the filtration system 108. The collection system 206 can include a hopper 208, for example, attached to the plenum 220, to receive the particles that fall from the particulate filter during filtering as well as pulsed air cleaning In some implementations, the hopper 208 can be a flanged, triangular hopper made of 12 gauge steel. The hopper 208 can include a box extruding on the back that penetrates the front bin wall of the particulate storage enclosure 102 with bolt pattern for 12" manifolding.

Figure 2B:
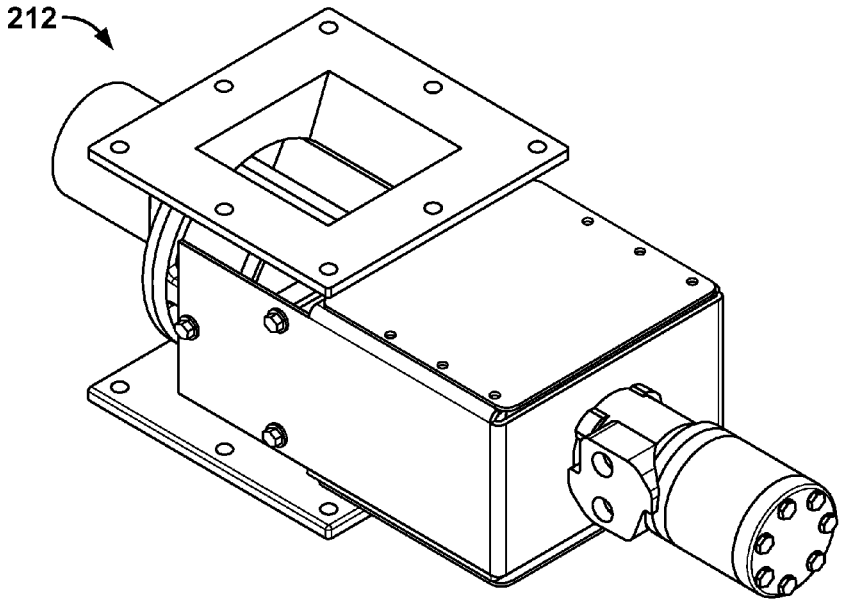
FIG. 2B is an example of an airlock valve connected to the filtration system.

The hopper 208 can be connected to a chute 210 to which an airlock valve 212 can be connected. The airlock valve 212, which can be an airlock rotary valve (provided by Smoot Company, Kansas City, Kans.) as shown in FIG. 2B, can be configured to permit the particulate filtered from the mixture to flow out of the collection system 206 through an outlet of the chute 210 while limiting flow of air out of the collection system 206. The airlock valve 212 can be cylindrical and can include multiple vanes that can be continuously spun at low speed with a hydraulic motor. Particulates that fall into the hopper 208 fall into a space between two adjacent vanes. As the vanes rotate, the particulates fall out of the airlock valve 212, for example, into a collection bin (not shown). Vanes on the other side of the airlock valve 212 limit or prevent flow of air out of the collection system 206. The hydraulic motor to which the airlock valve 212 is connected can be powered by the engine 106. In general, all hydraulic operations and electronic operations implemented by the systems described above can be powered by the engine 106.

Figure 3:
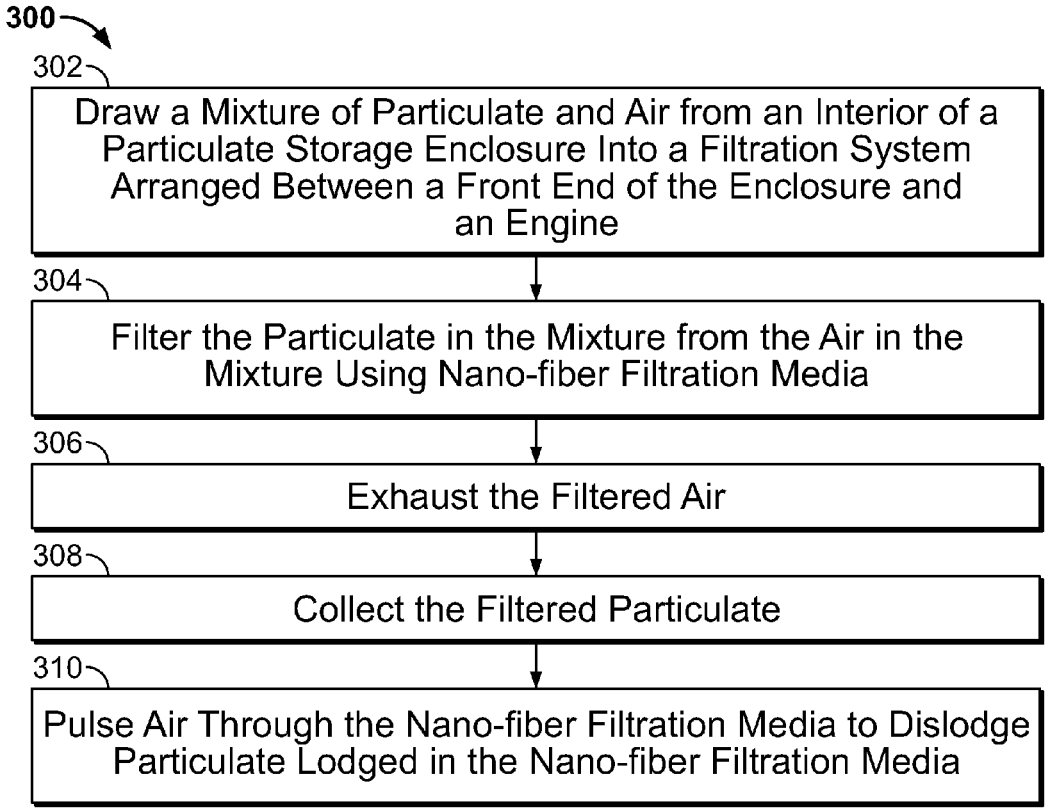
FIG. 3 is a flowchart of an example process of filtering particulate in a mixture of particulate and air.

FIG. 3 is a flowchart of an example process 300 of filtering particulate in a mixture of particulate and air. The process 300 can be implemented by a filtration system that is carried a particulate fracking storage trailer, for example, the filtration system 108. At 302, the filtration system 108 can draw a mixture of particulate and air from an interior of the particulate storage enclosure 102 carried by a trailer frame 104 with wheels 116. As described above, the filtration system 108 can be carried by the trailer frame 104 and be connected to the front end 110 of the particulate storage enclosure 102 that is proximal to the engine 106 also carried by the trailer frame 104. At 304, the filtration system 104 can filter the particulate in the mixture from the air in the mixture. At 306, the filtration system 108 can exhaust the filtered air. At 308, the collection system 206 can collect the filtered particulate. At 310, the air flow systems can pulse air through the nano-fiber filtration media to dislodge particulate lodged in the nano-fiber filtration media.

A number of embodiments have been described. Nevertheless, it will be understood that various modifications may be made without departing from the spirit and scope of the invention. For example, in addition to fracking trailers, the filtration system described above can be used in other areas such as grain silos, metal and wood fabrication shops, and the like. Accordingly, other embodiments are within the scope of the following claims.

What is claimed is:

1. A particulate storage fracking trailer, the trailer comprising:

a trailer frame with wheels;

an engine carried by the trailer frame;

a particulate storage enclosure carried by the trailer frame, the particulate storage enclosure having a front end proximal to the engine and a rear end distal to the engine; and a filtration system carried by the trailer frame and connected to the particulate storage enclosure at the front end, wherein the filtration system receives a mixture of particulate and air from an interior of the particulate storage enclosure, filters particulate from the air, and exhausts filtered air.

2. The trailer of claim 1, wherein the filtration system is proximate to a tongue end of a trailer.

3. The trailer of claim 1, wherein the filtration system is arranged between the particulate storage enclosure and the engine.

4. The trailer of claim 3, wherein the filtration system is arranged above the engine and below or at a trailer top height.

5. The trailer of claim 1, wherein the engine provides power to the filtration system.

6. The trailer of claim 1, wherein the filtration system comprises:

an inlet connected to the interior of the particulate storage enclosure to receive the mixture of particulate and air;

a particulate filter connected to the inlet to receive the mixture of particulate and air from the interior of the particulate storage enclosure;

a collection system to receive the particulate filtered from the mixture by the particulate filter; and an exhaust fan to flow the mixture of the particulate and air into the inlet through the particulate filter.

7. The trailer of claim 6, wherein the collection system includes an airlock valve configured to permit the particulate filtered from the mixture to flow out of the collection system while limiting flow of air out of the collection system.

8. The trailer of claim 7, wherein the hydraulic valve is an airlock rotary valve.

9. The trailer of claim 1, wherein the filtration system includes nano-fiber filtration media to filter the particulate from the air.

10. The trailer of claim 9, wherein the nano-fiber filtration media is configured as a flat filter cartridge.

11. The trailer of claim 8, wherein the filtration system includes air flow systems to pulse air through the nano-fiber filtration media to dislodge particulate lodged in the nano-fiber filtration media.

12. The trailer of claim 10, further comprising a compressor to flow compressed air through the air flow systems.

13. A method to filter particulate from air in a mixture of particulate and air, the method comprising:

drawing a mixture of particulate and air from an interior of a particulate storage enclosure carried by a trailer frame with wheels into a filtration system carried by the trailer frame and connected to a front end of the particulate storage enclosure that is proximal to an engine carried by the trailer frame;

filtering the particulate in the mixture from the air in the mixture; and exhausting the filtered air.

14. The method of claim 13, wherein drawing the mixture of the particulate and the air comprises drawing the mixture into the filtration system arranged between the particulate storage enclosure and the engine.

15. The method of claim 13, wherein drawing the mixture into the filtration system comprises drawing the mixture through an inlet of the filtration system arranged within the interior of the particulate storage enclosure.

16. The method of claim 13, wherein filtering the particulate in the mixture from the air in the mixture comprises flowing the mixture through nano-fiber filtration media.

17. The method of claim 16, further comprising pulsing air through the nano-fiber filtration media to dislodge particulate lodged in the nano-fiber filtration media.

18. The method of claim 13, wherein exhausting the filtered air comprises collecting filtered particulate in a collection system connected to the filtration system.

19. A particulate storage fracking trailer system comprising:

a particulate storage enclosure to receive a mixture of particulate and air in an interior of the particulate storage enclosure having a front end and a rear end; and a filtration system connected to the particulate storage enclosure at the front end to filter particulate from the air in the mixture and exhaust filtered air.

20. The system of claim 19, further comprising:

an engine arranged at the front end of the particulate storage fracking trailer to provide power to the filtration system, wherein the filtration system is arranged between the particulate storage enclosure and the engine; and a trailer frame with wheels to carry and transport the particulate storage enclosure, the filtration system, and the engine.

21. The system of claim 1, wherein the particulate comprises fracking particulate stored in the interior of the particulate storage enclosure.

22. The method of claim 13, wherein the particulate comprises fracking particulate stored in the interior of the particulate storage enclosure.

23. The system of claim 19, wherein the particulate comprises fracking particulate stored in the interior of the particulate storage enclosure.

* * * * *